US006787688B2

(12) United States Patent
Harmos et al.

(10) Patent No.: US 6,787,688 B2
(45) Date of Patent: Sep. 7, 2004

(54) MUSICAL INSTRUMENT

(75) Inventors: T. Sage Harmos, Minneapolis, MN (US); James I. Baecker, Deephaven, MN (US)

(73) Assignee: Harmos Music, Ltd., Deephaven, MN (US)

( * ) Notice: Subject to any disclaimer, the term of this patent is extended or adjusted under 35 U.S.C. 154(b) by 0 days.

(21) Appl. No.: 10/190,254

(22) Filed: Jul. 5, 2002

(65) Prior Publication Data

US 2003/0010180 A1 Jan. 16, 2003

Related U.S. Application Data

(60) Provisional application No. 60/303,566, filed on Jul. 6, 2001.

(51) Int. Cl.[7] ..... G10D 3/00

(52) U.S. Cl. ..... 84/291; 84/267; 84/312 P; 84/402; 84/403

(58) Field of Search ..... 84/291, 267, 312 R, 84/411 P, 402, 403

(56) References Cited

U.S. PATENT DOCUMENTS

| | | | | | |
|---|---|---|---|---|---|
| 2,986,241 | A | | 5/1961 | Fuller | 189/34 |
| 3,701,834 | A | * | 10/1972 | Rubio | 84/419 |
| 3,776,091 | A | * | 12/1973 | Suzuki | 84/403 |
| 4,079,652 | A | | 3/1978 | Gittler | 84/1.16 |
| 4,213,370 | A | * | 7/1980 | Jones | 84/291 |
| 5,587,541 | A | * | 12/1996 | McIntosh et al. | 84/297 S |
| 5,895,872 | A | | 4/1999 | Chase | 84/291 |
| 6,008,440 | A | | 12/1999 | Yamada | 84/291 |
| 6,075,198 | A | | 6/2000 | Grant et al. | 84/731 |
| 6,169,236 | B1 | | 1/2001 | Pilar, Jr. | 84/291 |
| 6,188,005 | B1 | | 2/2001 | White | 84/291 |
| 6,239,339 | B1 | | 5/2001 | Sembach | 84/410 |

OTHER PUBLICATIONS

Cctave Frequency Chart, Christiian Musician Resource Center.*

Chrysalis Guitar Company, Inc. Chrysalis Guitar System Components, the Big Picture. www.chrysalisguitar.com/exploded_chrysalis_guitar.html. Jun. 14, 2001.

* cited by examiner

*Primary Examiner*—Shih-Yung Hsieh
(74) *Attorney, Agent, or Firm*—Nawrocki, Rooney & Sivertson, P.A.

(57) ABSTRACT

The present invention includes a musical instrument that is lighter in weight, and utilizes less raw material to construct than traditional instruments. Some embodiments of the present invention also provide unique resonance characteristics over prior instrument designs. Additionally, the present invention includes embodiments of a musical instrument that are constructed utilizing the improved strength and rigidity qualities of space frame technology.

16 Claims, 5 Drawing Sheets

16
42
18
32
5
4

MUSICAL INSTRUMENT

This application claims the benefit of provisional application No. 60/303,566 filed Jul. 6, 2001.

BACKGROUND OF THE INVENTION

The present invention relates generally to the field of musical instruments. In particular, the present invention involves an improved musical instrument having a frame or body that is lightweight and compact. Additionally, in some embodiments, the instrument can be designed to offer unique resonance characteristics.

Musical instruments are formed having a means for producing a vibration of a fluid or magnetic field surrounding the instrument, the fluid most often being air. The vibration, when received by the human ear, is interpreted as an audible sound. In order to produce enough sound to be useful to a musician, in playing music, the instrument must have a means for harnessing the vibration or must amplify the vibration.

Further, all musical instruments have a sound generating mechanism, that produces one or typically a plurality of vibrations at a plurality of frequencies, and have a body to which the generating mechanism is attached. The sound created by a sound generating mechanism (e.g. strings, drum heads, and the like) may occasionally be comprised of a single natural frequency, but nearly always, the sound is comprised of several frequencies, with the first, or lowest, natural frequency usually being the dominant one. This lowest, first natural frequency is often referred to as the fundamental frequency. For example, a violin playing concert A pitch generates a sound spectrum comprised of vibrations at many frequencies, but wherein most of the sound energy is concentrated at 440 Hz. This lowest natural frequency is often referred to as the fundamental frequency of concert A.

In stringed instruments, for example, the body of an instrument, such as a guitar, may be hollow in order to amplify the vibrations produced by the strumming or plucking of the strings attached to the instrument. However, in order to provide a large enough cavity to produce the required amount of sound, the body portion of these devices has traditionally had to be large. Typically, one problem with a large body has been the awkwardness of the large shape of the device in use and in storage.

A solid has also traditionally been used to make an instrument body, such as a guitar. This style is comprised of a solid, typically wood, body and one or more electrical pickups used to interpret the vibration of the sound generating mechanism interpreted by the instrument for purposes of amplification. The solid body is used to provide a structure on which to mount the strings and pickups. However, since these devices are constructed of a solid body, they are typically heavy and, therefore, are undesirable for long periods of use.

A common problem with musical instruments is that the body also has its own natural frequencies and will, therefore, begin to resonate as it is affected by the vibrations emanating from the sound generating mechanism. The amplitude and spectrum of these additional body vibrations may be of a benefit to a musician, however, in some situations these vibrations may be unwanted noise or, worse, may interact with the musical tones created by the sound generating mechanism to form dead spots or hot spots within the audible range of the instrument. These body vibrations may also act to distort the audible spectrum of the sound generating mechanism.

The equation generally utilized to identify the natural frequencies of a physical thing includes the components $$\sqrt{\frac{k}{m}}$$

where k=stiffness and m=mass. In this equation, to account for multiple modes of vibration the components k and m may be matrices. The vibrational spectrum of an instrument body is what characterizes its performance. The vibrational spectrum of an instrument body also has a resonance spectrum. Resonance peaks occur as modal natural frequencies or a combination of multiple modal natural frequencies within the vibrational spectrum. The peak resonance of a body is the highest amplitude resonance measured during a resonance test.

Traditionally, it has been believed that the best sound quality could be produced if the mass of the body was high and if the stiffness of the instrument body was also high, because the instrument would be capable of a wide range of tones without a significant amount of unwanted tone produced by the instrument body itself. However, the result of this combination is an instrument body with high mass, and high stiffness that has its set of resonance peaks falling primarily within the range of fundamental frequencies of the played notes of the sound generating mechanism. The range of played notes is called the tonal range.

Most instruments still attempt to achieve the stiffness necessary to form these tones by utilizing traditionally known stiff materials, such as aluminum, wood, or carbon fiber sheets in traditional constructions. For example, a solid bodied guitar, having high stiffness, but also has high mass. However, since the mass is high to accomplish the stiffness, similarly, the instrument body absorbs and attenuates portions of the tonal range and lower harmonics of the sound generating mechanism.

It is theorized that the sound quality of an instrument is improved by minimizing the presence of modal resonance peaks of the body at frequencies within the tonal range of the sound generating mechanism. Modal resonance peaks are a result of the natural frequencies of the instrument body itself and, therefore, changes to the traditionally utilized body construction must be made to accomplish minimization of these peaks.

SUMMARY OF THE INVENTION

The present invention includes a musical instrument that is lighter in weight, and utilizes less raw material to construct than traditional instruments. Some embodiments of the present invention also provide unique resonance characteristics over prior instrument designs. Additionally, the present invention includes embodiments of a musical instrument that are constructed utilizing the improved strength and rigidity qualities of space frame technology.

Music can be generated by a wide variety of different musical instruments. One of the ways the ear distinguishes one instrument from another is by the differences in the frequency spectrum generated by those instruments. For example, as stated above, a violin playing concert A pitch generates a note in the tonal range and a sound spectrum with most of the sound energy concentrated at 440 Hz, the fundamental frequency of concert A. Similarly, a piano playing a concert A pitch also generates a note in the tonal range and a sound spectrum with most of the sound energy concentrated at 440 Hz. However, the sounds created by the two instruments can be distinguished even though the same fundamental frequency is being played. This difference is known as timbre.

Several factors allow the ear to differentiate a pitch that has been generated. The tone initiation, sometimes called attack, and the timbre are two primary factors in sound differentiation. The timbre of an instrument is generally considered to be defined by the relative magnitudes of the overtone frequencies generated by the instrument.

For two similar instruments, e.g. two violins, timbre is considered the most important method for determining the sound quality between the instruments. That is to say, the overtones and auditory frequency spectrum generated by a specific instrument become the primary method in differentiating the musical quality of similar instruments.

As outlined above, for many instruments, but primarily for stringed and percussion instruments, the spectrum of resonance frequencies that constitute the sound spectrum of the body, significantly differentiates timbre. For example, for a guitar, with the same gauge and type of strings, tuned the same way, and plucked or played the same way, the difference in musical timbre, or tone, relates directly to the instrument body holding the sound generating mechanism, in this case the strings.

Modes of body vibration and the resonance frequencies in the body vibration spectrum can be modeled by finite element analysis (FEA) or with more accuracy, by testing. A simple but effective test method for instrument body resonance spectrum analysis is the impulse or "tap"test.

In this test, the tapping or striking of a physical body sharply with a stiff striker such as a small hammer or metal bar will cause the body to resonate. Assuming the instrument body has been physically isolated from its surroundings, when tapped, it will resonate at all of its resonance frequencies within its range to generate its sound spectrum.

By using a vibration (sound) sensing device such as a low mass accelerometer attached directly to the body, or by measuring the air movement emanating from the body in free oscillations after it is struck, the resonance spectrum can be recorded and analyzed. By providing the time based resonance spectrum data to an instrument such as a spectrum analyzer and/or by performing a Fourier transform on the data, the data can be converted to frequency based information. This information shows the resonance spectrum of the instrument body, i.e. the frequencies that the instrument body enhances or amplifies, and those that it attenuates. This analysis allows timbres of different instruments to be compared.

For a tap or impulse test on a solid body, the contact of the body with the air is considered to have negligible effect on the resonance frequencies spectrum of the body. However, the body should be isolated from other physical structures. For example, allowing the body to be suspended under its own weight from a light string acts to isolate the body from the physical bodies around it, while having only negligible effects on the body resonance spectrum.

Additionally, in order to gather a complete spectrum for analysis, it is best to tap the body at many diverse locations on the surface of the body. The monitoring device or devices can be located at several locations around the instrument, or at a central location, so that the device captures resonance spectrum information in a balanced way.

The natural frequencies of the body are constrained by the physical limitations of the modulus of elasticity, the shape, and the density of the materials utilized. For example, typical guitar bodies' lowest natural frequencies and peak resonances are in the 30–500 Hz range. It should be noted that these are calculated only with respect to the instrument body itself and not the resonance of the body of air enclosed by the instrument.

Further, by the laws of physics, (see FIG. 7) a music-generating mechanism vibrating at frequencies less than 1.4 times the natural frequency of the specific vibrational mode of the instrument body will be supported or amplified by that mode. Similarly, for generated frequencies greater than 1.4 times the natural frequency of that mode, the instrument body will attenuate or absorb the sound energy of those frequencies. Based upon this principle, a musical instrument body having its modal natural frequencies primarily above the fundamental frequencies typically generated by the sound generating mechanism allows for the support and amplification of those fundamental frequencies and of a wide range of generated musical overtones without absorption and attenuation by the instrument body.

The body of an instrument constructed according to the present invention may have any design that has the described tonal characteristics. For example, a space frame design provides the desired tonal characteristics and also offers excellent stiffness-to-weight and compact design advantages over prior instrument designs.

Space frame technology has long been known and utilized in the field of building construction to improve the strength and rigidity of buildings while reducing the amount of raw materials needed to provide such strength and rigidity. These advantages have been accomplished by the use of simple structural elements and the organization of those elements into orderly geometric polygonal structures. A number of structures may then be connected together, with each structure providing strength to the others, thereby creating a space frame. U.S. Pat. No. 2,986,241, to Richard Buckminster Fuller (hereafter, Fuller), provides good background information regarding the known benefits of strut-type and sheet-type space frame technology, both of which are suitable for application in the present invention, and its subject matter is, therefore, incorporated herein by reference. Any suitable structure providing a space frame design may be utilized. For example, suitable types of space frames include, but are not limited to: strut-type frames, sheet-type frames, and combinations of the two types.

A space frame as applied within this document is a portion of an instrument body shape that has been segmented into a plurality of polyhedral shapes, each having a plurality of faces or sides, with adjacent shapes being in a face to face relationship. Each shape defines a space therein, by a plurality of load bearing members, such as struts, sheets, and the like. It should be noted that the body may be comprised of a plurality of space frames interstitially arranged with respect to each other.

Space frame principles, as applied to building construction, have shown increased structural rigidity and strength with a reduction in raw materials, weight, and space. However, these principles have not been applied to musical instruments. Further the resonance characteristics of a device constructed according to these principles have not been investigated. The resonance characteristics of these style devices are harnessed in embodiments of the present invention.

For example, in one embodiment of the present invention, a stringed musical instrument is comprised of a body constructed from spars in which the spars are arranged utilizing space frame principles. A mechanism for generating a musical tone, such as a vibratory string, set of strings, or drum head, for example, is tensioned across at least a portion of the body. In the stringed embodiment, the tension of the strings is preferably adjustable and the strings should be removable, allowing for their replacement. The body also may have one or more pickups mounted thereto for amplifying the resonance of the string or strings. The body may also have an amplifying unit mounted thereto to aid in amplification, such as an electric pickup. In the stringed embodiment, a fret board may be applied between the space frame and the strings. However, for applications such as for steel-style guitar playing, the device may be utilized without a fret board.

Preferably the instrument, regardless of what style space frame is utilized, has a mechanism for generating a musical tone and a body attached to the mechanism. The body preferably has a peak resonance frequency of at least 1,100 Hz.

The aforementioned benefits and other benefits including specific features of the invention will become clear from the following description by reference to the accompanying drawings.

DETAILED DESCRIPTION OF THE INVENTION

Figure 1:
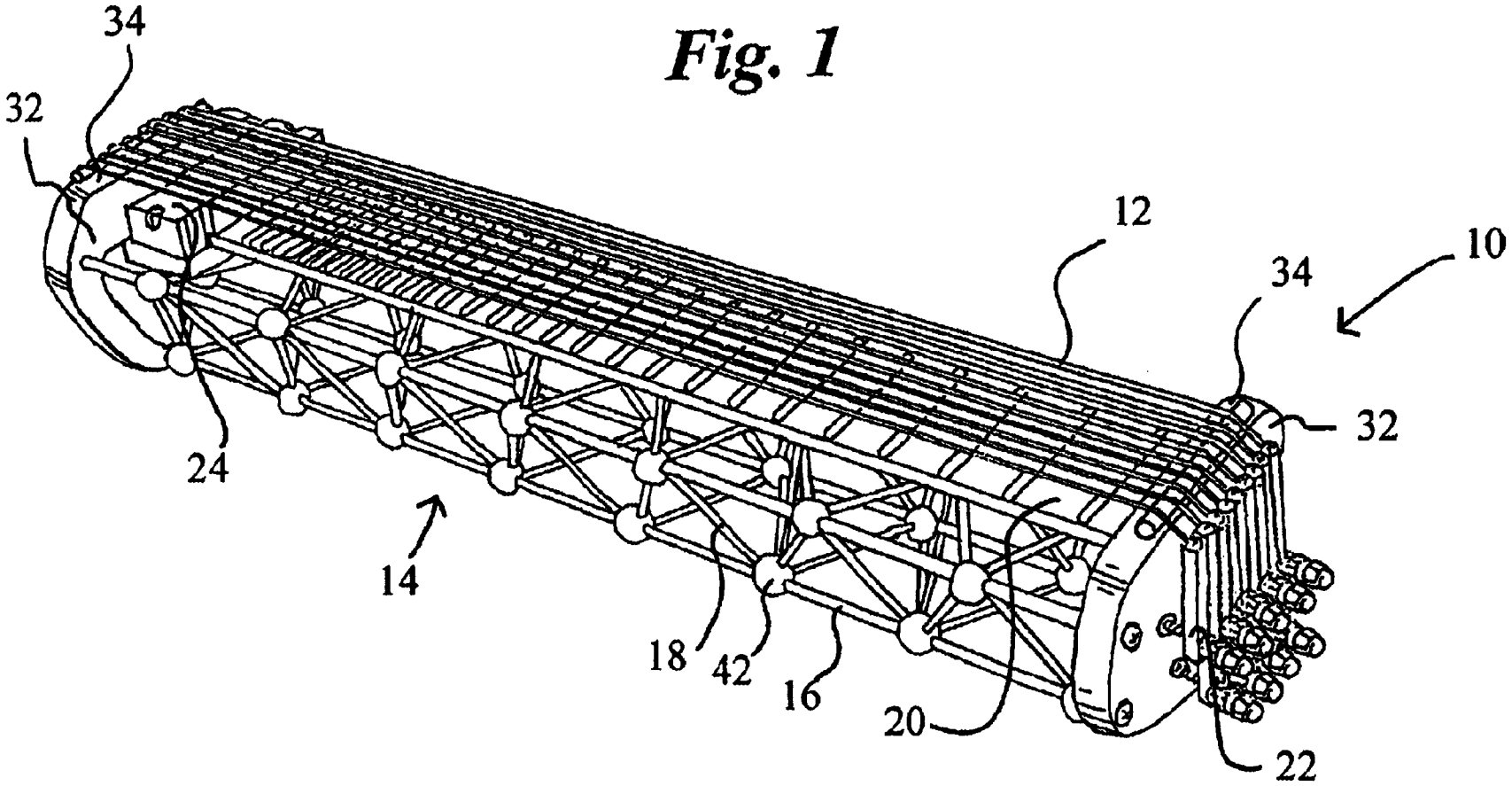
FIG. 1 is an a perspective view of one embodiment of the present invention wherein the device is a stringed instrument having a fret board positioned between the body and the strings.

Referring now to the drawings wherein like reference numerals denote like elements throughout the several views, FIG. 1 illustrates an angled top view of a guitar embodiment of the present invention.

Figure 6:
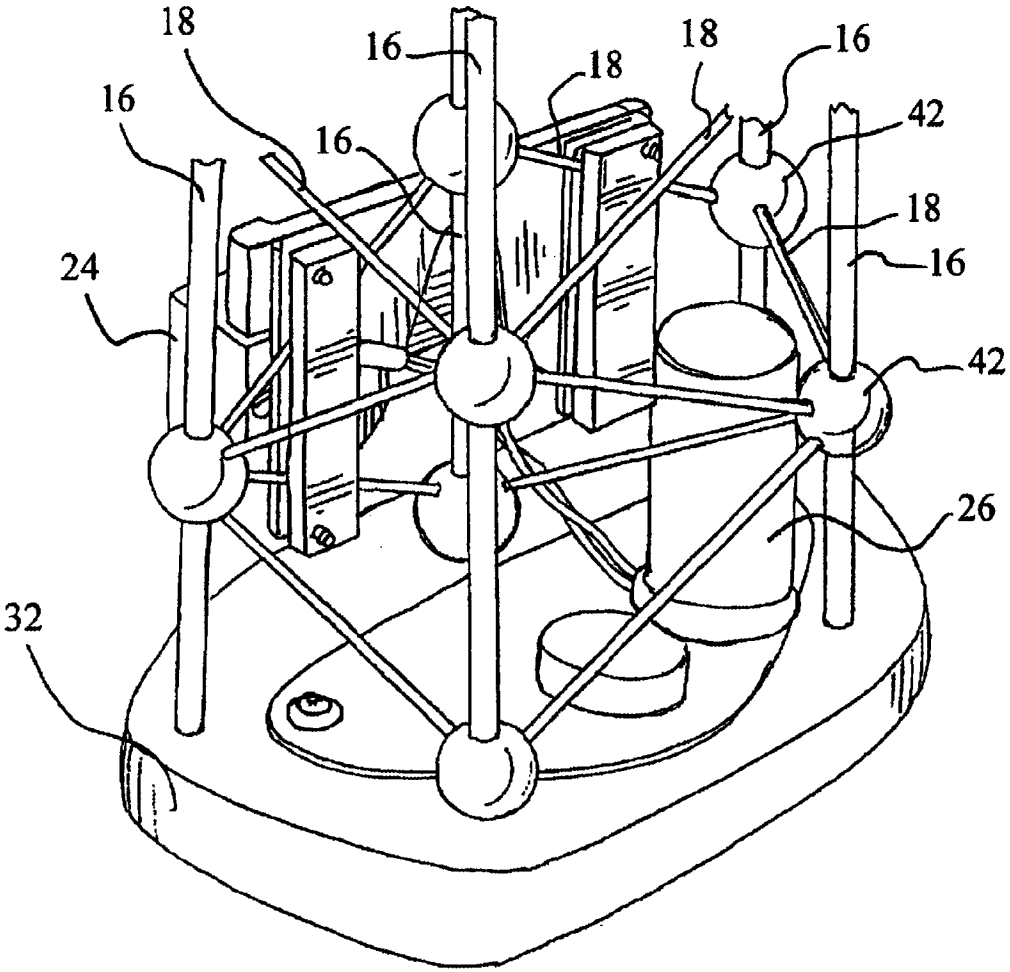
FIG. 6 is a sectional view of the device of FIG. 1 showing the positioning of electronic components on mounted on the device.
Figure 7:
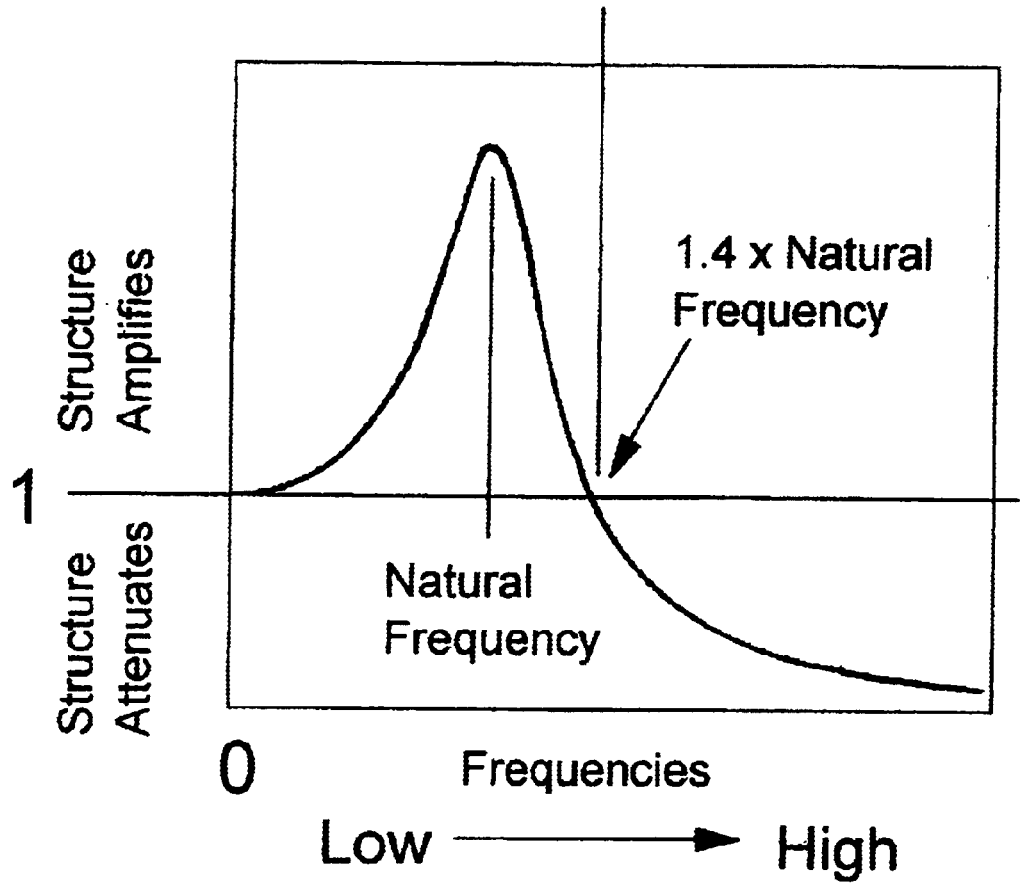
FIG. 7 is an example of a graph of a transmissibility curve for a mechanical body.

The embodiment shown is a device 10 forming a lap-style steel guitar, generally comprising a set of strings 12 strung along a length dimension between two ends 32 of a body 14. The body 14 is comprised of a strut-style frame having a plurality of strut elements 16 and 18 arranged to form a plurality of polygonal shapes forming a space frame. As shown in FIGS. 1 and 6, the device 10 may also comprise a fret board 20, means 22 for tensioning, adjustment and replacement of the strings 12, one or more pickups 24, and an electrical power source 26. The device 10 may also include a shoulder strap for supporting the device 10 around the neck of a user, and a positioning member for positioning the device 10 for playing while standing (neither shown). Additionally, FIG. 1 shows strings 12 stretched across the length of the frame between the ends 32 of the body 14 to place a portion of body 14 in compression. The ends 32 may be comprised of any suitable material and may be solid or space frame in design. For example, as shown in the Figures, the ends 32 may be comprised of a solid material such as wood. However, metal, carbon fiber, polymers, or other materials may be utilized within the scope of the present invention. Additionally, the strings 12 may be stretched over only a portion of the body 14 if desired.

Furthermore, a portion of the body may be comprised of a frame generally constructed from spars such as strut elements 16 and 18 and one or more portions constructed of other materials. For example, the device may have a lower portion, comprised of a frame structure, and a neck, made from a solid material such as wood. With respect to an embodiment of a piano-style instrument, the body is generally comprised of a harp, a frame including a rim and support structure. A space frame structure may be utilized for either a portion of the harp, the frame, or both. It is also preferred that the space frame structure be utilized in the portion of the body that provides the primary support structure for the sound generating mechanism. For example, in the embodiment shown in the Figures, the primary support structure is the portion of the body 14 that carries the structural and resonant loads of the sound generating mechanism, in this case the strings 12.

Figure 2:
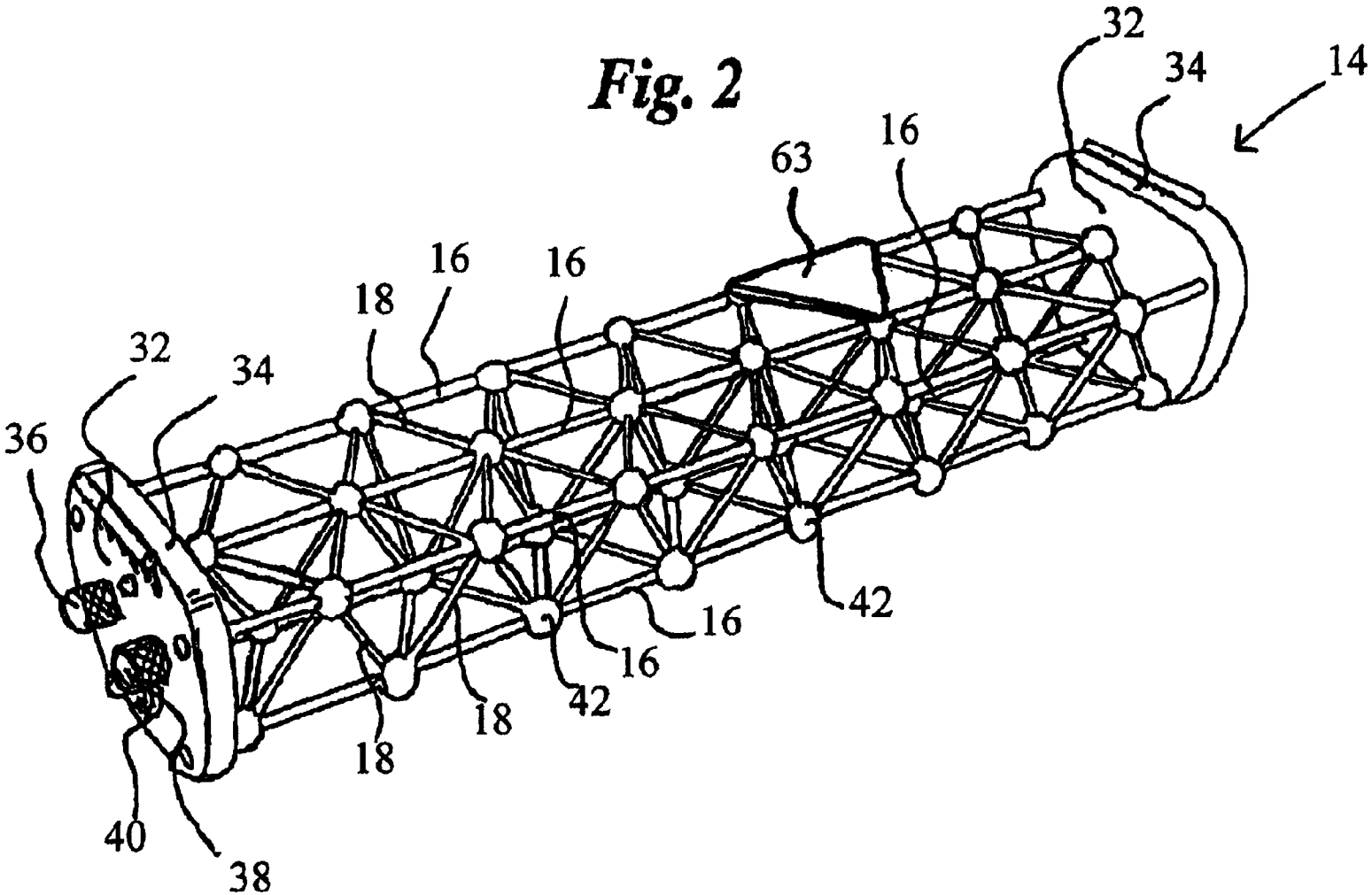
FIG. 2 is a perspective view of an embodiment of the present invention without a fret board and with the strings removed.

In the embodiment shown in FIGS. 1 and 2, the ends 32 have top surfaces 34 that may provide a nut and a saddle for the strings 12. The nut and saddle may be provided by the material of the end 32 itself or, as shown in the Figures, may be comprised of a separate material mounted thereon. The ends 32 may also be utilized to mount electrical equipment or string or amplification adjustment mechanisms thereon, as is shown in FIGS. 1 and 2. FIG. 6 shows an electrical power supply 26 and pickup 24 mounted adjacent to one end 32 of the device 10. This arrangement allows volume 36 and tone 38 controls and a power input/output receptacle 40 as shown in FIG. 2, to be positioned on the end 32 adjacent to the power supply 26 and pickup 24.

As is shown particularly in FIG. 2, a spar-style device 10 has at least a portion of the body 14 comprised of a plurality of spars 16 and 18. The spars are connected together to form a plurality of polygonal shapes. For example, one common polygonal shape utilized in forming space frame structures is the tetrahedron. A regular tetrahedron is a basic three-dimensional structure having four sides, each comprising identical equilateral triangles. Although other equilateral and non-equilateral geometric shapes may be utilized, this is the preferred embodiment. Therefore, preferably, the shapes of the polygons forming body 14 are tetrahedrons, although octahedrons or any other suitable shape may also be utilized.

Most preferably, one or more octet truss systems may be utilized having an assemblage of octahedrons and tetrahedrons in face to face relationship. Thus the major axes of all octahedrons forming a truss are in parallelism throughout the framework. Together, these figures are comprised in a single, or common, octahedron-tetrahedron system. The truss may also be comprised of half octahedrons. The octet truss system arrangement is preferred because it is believed to distribute force more evenly than many other geometries while exhibiting an extremely favorable weight-to-strength ratio. When a plurality of trusses are utilized, the trusses may be spaced apart from each other, adjacent, or integrally connected together.

The plurality of polygons are constructed having common spars, thereby joining several polygons together. This structure creates a space frame. If octahedrons formed from tetrahedrons are utilized, the frame may be referred to as an octet truss or an octahedron tetrahedron space frame. Such a type of space frame forms at least a portion of the body 14 of the instrument. The structure may be formed from spar elements, planar sheet elements in a geometric array, a plurality of preconstructed polygons, or portions of the space frame, or the entire space frame may be constructed as a single unitary structure. One sheet element 63 is shown in FIG. 2 as part of a truss-type space frame. The elements may also be comprised from any suitable material known in the art, such as, but not limited to, wood, metal, carbon fiber, polymers, etc. Additionally, the spars may be of any suitable shape and, for example, may form a cylindrical rod shape or a portion of a sheet of material.

The embodiment of the devices shown in the Figures provides a body structure comprised of two ends 32, a plurality of elongated spars 16, a plurality of short spars 18, and a plurality of attachment members 42. The ends 32, the short spars 18, and the attachment members 42, as shown, are constructed of wood with the elongate spars 16 being constructed of carbon fiber tubes. The above parts may be solid or hollow and may be fabricated from any suitable material. Additionally, although it is preferred that elongated and short spars be used, the present invention may be constructed utilizing spars having a uniform length, or having more than two lengths.

Additionally, in the illustrated embodiment, the attachment members 42 are sphere shaped and have holes drilled through them to allow them to be slid onto the elongated spars 16, positioned thereon, and fixed thereto. The attachment members 42, if utilized, may be of any shape. The attachment members shown, have holes drilled into their surfaces for attachment of the ends of several short spars 18. Once the attachment members 42 are positioned on the elongated spars 16, the short spars 18 may be attached to the attachment elements 42. In the embodiment shown, the ends of the elongated spars 16 are attached to the ends 32. Attachment of the different parts may be accomplished by any means known in the art. For example, the device 10 shown has some parts attached by mechanical means, such as screws or frictional fit, while other parts are adhesively affixed. Additionally, the spars 16 and 18 may have any suitable exterior shape.

Figures 3, 4, 5:
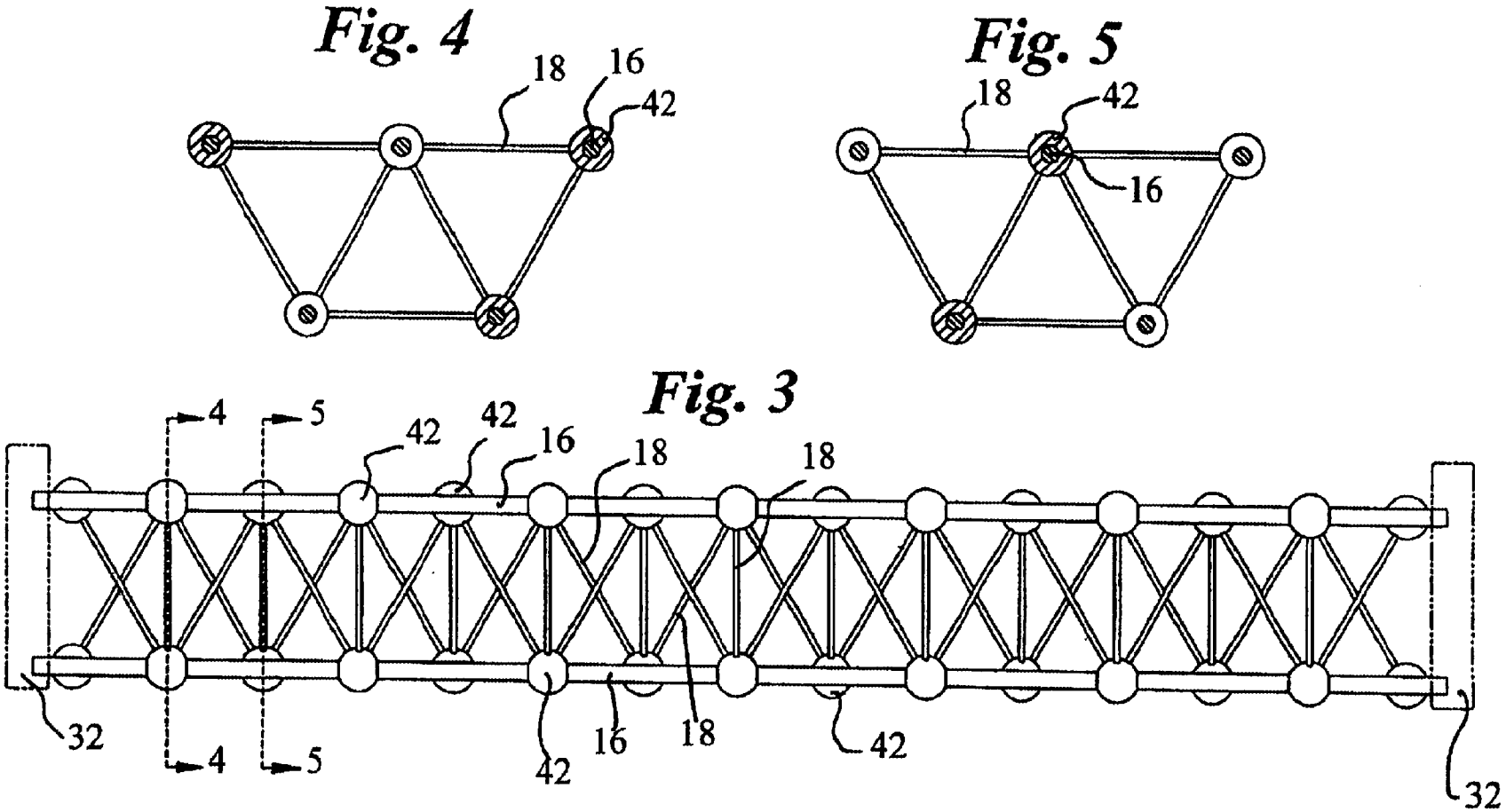
FIG. 3 is a side view of the embodiment of FIG. 2.
FIG. 4 is a cross-sectional view of the embodiment of FIG. 2 taken along line 4—4.
FIG. 5 is a cross-sectional view of the embodiment of FIG. 2 taken along line 5—5.

Further, the space frame portion may fill the entire interior of the shape of the instrument body, or may form just a portion, such as the exterior shape of the body. The latter embodiment would be particularly applicable to percussion instruments, such as drums, wherein the space frame design could form the exterior shape with a cavity formed in the interior. A skin could be placed around the exterior of the space frame shape to form the exterior of the drum. It is also conceivable that some embodiments of the present invention may have the entire interior of the drum or other instrument comprised of space frame material, as is shown in FIGS. 1–3. The skin may be constructed from any suitable natural or manmade material known in the art.

Although only a guitar style stringed musical instrument is provided as an example herein, the present invention may be utilized in many musical instrument designs, for example stringed instruments, like piano-style instruments, such as pianos, harpsichords, hammered dulcimers and the like; guitar family instruments, guitars, bass guitars, banjos, sitars, "Chapman" sticks, and the like; viol family instruments, such as violins, violas, cellos, basses, and the like; the many variations of harps; marimba-style instruments, such as xylophones and the like and could be used as a resonating bar for such an instrument; and percussion instruments, such as drums, and the like. Further, the embodiments of the present invention may have resonating components incorporated therein, such as acoustic sound boards, resonator cones, sympathetic strings, resonating rods or forks, tone chambers, and the like.

Some embodiments of the present invention combine the low density of carbon fiber and relatively high modulus of elasticity of carbon fiber with the high strength-to-weight ratio of a space frame structure to generate peak resonance frequencies of about 1,200 Hz. This means that a musical instrument body constructed according to the present invention would act to pass through or amplify the fundamental pitches and lower harmonics. Furthermore, once a body with peak resonance at a high frequency has been created, if a body with its peak resonance at lower frequency is desired, it can be created simply by adding mass to the body, or reducing the stiffness of the body.

Further, embodiments such as that shown in the Figures also seem to have low damping, thereby reducing the effects of damping on the length or sustain of instrument tones. It is most preferred that the body have a damping coefficient of less than 0.05 at 1,200 Hz.

As described previously, one method of determining the instrument body resonance spectrum is the tap test. This test is performed on a musical instrument which is sufficiently mechanically isolated from its surroundings that a change in surroundings has negligible effect on the spectrum generated. Isolation includes disabling, but not necessarily removal of the sound generating mechanism.

With one or more sensing devices located on or adjacent to the instrument, tap tests are performed at various places around the musical instrument. Typically the tap locations are chosen to provide the greatest possibility of excitation of lowest frequency modes. The sensing device(s) also should be located to provide good indications of the lowest frequency modes. As each location around the musical instrument is tapped, a time-based file of data is recorded from the sensors. For this testing method, 25 individual sets of tap data were obtained from 8 different tapped locations on the musical instrument. A large condenser microphone, located adjacent to the center of the musical instrument body 14, was used to sense the instrument sound spectrum. Data was recorded from the microphone at 44,000 samples per second.

The Fast Fourier Transform (FFT) can be performed on the time based data to yield the frequency-based spectra of the individual tap tests. Averaging the individual spectrum data from several tap test locations around the instrument gives the overall instrument frequency spectrum, since the auditory senses of a person listening to the instrument averages the sound spectra coming from the various locations on the instrument.

In one test example, a lap steel guitar constructed according to the present invention was tested. The individual tap test locations showed the peak resonance frequency to be above 1,150 Hz. In addition, averaging the individual spectra across the test locations confirmed a peak resonance frequency for all locations above 1,100 Hz. For comparison, prior guitar designs were similarly tested. These tests indicated that prior designs have individual and average peak resonance frequencies between 30 and 500 Hz.

Also, by dividing an averaged location spectrum into a number of different groupings, each of which are divided into individual ranges of 100 to 3,000 Hz, the consistency of the instrument sound spectrum can be determined. For example, if the spectrum is divided such that the 0 to 2,000 Hz portion of the spectrum amplitudes is averaged across 100 Hz ranges, the 2,000 to 4,000 Hz portion of the spectrum amplitudes is averaged across 500 Hz ranges, the 4,000 to 7,000 Hz portion of the spectrum amplitudes is averaged across 1,000 Hz ranges, the 7,000 to 11,000 Hz, portion of the spectrum amplitudes is averaged across 2,000 Hz ranges, and the 11,000 to 20,000 Hz portion of the spectrum amplitudes is averaged across 3,000 Hz ranges, a graph of the body 14 spectral response can be generated.

An embodiment having the structure of device 10 was tested. The average spectral amplitude for such an embodiment from 1,150 Hz to 5,500 Hz was within 2 db of the amplitude of the peak resonance range. Prior designs show attenuation for similar ranges of at least 7 db to as much as 15 db below the peak resonance amplitude within 4,350 Hz above the peak resonance frequency.

Further, mechanical damping manifests itself most significantly in two ways. First, low damping tends to increase the resonance amplitude and, second, low damping allows instrument body resonance to sustain longer. For complex mechanical systems, damping is quantified by a damping coefficient and is most commonly measured using a decay test. The decay test is performed by exciting the body being tested to a known vibrational frequency, such that the body oscillations can be detected. Then, after terminating the excitation of the body and allowing the body to oscillate freely, the decay rate of the body oscillations is measured. For low damping coefficients, the damping coefficient is considered to be the natural log of the ratio of two successive oscillation amplitudes of the decay divided by 2n.

Preferably, the damping coefficient of instruments constructed according to the present invention should be less than 0.05 at 1,200 Hz. In a test of an embodiment constructed according to the present invention, such as that shown in the Figures, the damping coefficient of the instrument, with the musical generating mechanism disabled, and being excited at 1,200 Hz measured 0.025.

Since many possible embodiments may be made of the present invention without departing from the scope thereof, it is to be understood that all matter herein set forth or shown in the accompanying drawings is to be interpreted in the illustrative and not limiting sense.

What is claimed is:

1. A musical instrument, comprising;

a mechanism for generating a musical sound; and a body attached to said sound generating mechanism, at least a portion of said body comprising a space frame.

2. The musical instrument according to claim 1, wherein said sound generating mechanism comprises at least one string.

3. The musical instrument according to claim 2, wherein the body has a length dimension, and includes an end attached to the body, and wherein the at least one string is attached to the end and stretched along the length dimension of the body.

4. The musical instrument according to claim 1, wherein said space frame portion is a truss-type space frame.

5. The musical instrument according to claim 4, wherein said truss-type space frame is an octet truss.

6. The musical instrument according to claim 1, wherein said space frame includes at least one sheet-type frame member.

7. The musical instrument according to claim 1, wherein the body has a length dimension and wherein said sound generating mechanism comprises a tensioned string attached to place at least a portion of the space frame in compression along the length dimension.

8. The musical instrument according to claim 1, wherein said space frame portion comprises a plurality of spars and a plurality of attachment members, said attachment members having holes therein to receive said spars and support said spars to form the space frame.

9. The musical instrument according to claim 1, wherein said space frame portion of said body is constructed from carbon fiber.

10. A musical instrument, comprising;

a mechanism for generating a musical tone; and a body attached to said sound generating mechanism, said body having frequency response characteristics generating a peak resonance frequency occurring at or above 1,100 Hz.

11. The musical instrument according to claim 10, wherein said body generates a plurality of frequencies and wherein when said frequencies are divided into groups of frequency ranges, each range of between 100 and 3,000 Hz, and when an average of the amplitudes of said frequencies within each of said ranges within a group are calculated, each of, said averages of the frequency amplitudes of each group are within 2 db of the highest group average.

12. The musical instrument according to claim 11, wherein said body has a damping ratio of less than 0.05 at 1,200 Hz.

13. The musical instrument according to claim 10, wherein said body generates a plurality of resonance frequencies, one of which is a peak resonance frequency, and wherein said frequencies greater than 80 Hz and less than and including said peak resonance frequency are divided into ranges of between 80 and 120 Hz, and the amplitudes of the frequencies within each of said ranges are averaged, said averages are within 6 db of the amplitude for the range that includes said peak resonance frequency.

14. The musical instrument according to claim 13, wherein said body has a damping ratio of less than 0.05 at 1,200 Hz.

15. The musical instrument according to claim 10, wherein said body has a damping ratio of less than 0.05 at 1,200 Hz.

16. The musical instrument according to claim 10, wherein at least a portion of said body comprises a space frame.

* * * * *